US008342727B2

(12) United States Patent
Owen, Sr. et al.

(10) Patent No.: US 8,342,727 B2
(45) Date of Patent: Jan. 1, 2013

(54) MOLDED ELECTRICAL SOCKET

(75) Inventors: Robert H. Owen, Sr., Columbia City, IN (US); John A. Forish, Huntertown, IN (US)

(73) Assignee: Federal-Mogul Ignition Company, Southfield, MI (US)

( * ) Notice: Subject to any disclaimer, the term of this patent is extended or adjusted under 35 U.S.C. 154(b) by 638 days.

(21) Appl. No.: 12/243,245

(22) Filed: Oct. 1, 2008

(65) Prior Publication Data

US 2009/0029596 A1 Jan. 29, 2009

Related U.S. Application Data

(63) Continuation-in-part of application No. 11/553,193, filed on Oct. 26, 2006.

(60) Provisional application No. 60/730,448, filed on Oct. 26, 2005.

(51) Int. Cl.
*F21V 15/01* (2006.01)

(52) U.S. Cl. ..... 362/546; 362/548; 362/549

(58) Field of Classification Search ..... 362/459–549
See application file for complete search history.

(56) References Cited

U.S. PATENT DOCUMENTS

| | | | | |
|---|---|---|---|---|
| 4,631,651 | A | 12/1986 | Bergin et al. | |
| 5,156,560 | A * | 10/1992 | Thomas | 439/699.2 |
| 6,139,334 | A * | 10/2000 | Forish et al. | 362/487 |
| 6,254,252 | B1 | 7/2001 | Coushaine et al. | |
| 2003/0178926 | A1 | 9/2003 | Bryant | |
| 2004/0165411 | A1 * | 8/2004 | Heath et al. | 365/110 |

FOREIGN PATENT DOCUMENTS

| | | | |
|---|---|---|---|
| JP | 5039373 | A | 2/1993 |
| JP | 07312272 | | 11/1995 |
| JP | 08008011 | | 1/1996 |
| JP | 08-250076 | | 9/1996 |
| JP | 08236232 | | 9/1996 |
| JP | 2000-3767 | | 1/2000 |
| JP | 2000208199 | | 7/2000 |
| JP | 2004-523079 | | 7/2004 |
| KR | 1020000065132 | | 11/2000 |
| WO | 2007050710 | A2 | 5/2007 |
| WO | 2007050710 | A3 | 11/2007 |

OTHER PUBLICATIONS

European Search report EP09818490 mailed on May 23, 2012.

* cited by examiner

*Primary Examiner* — William Carter
(74) *Attorney, Agent, or Firm* — Robert L. Stearns; Dickinson Wright, PLLC

(57) ABSTRACT

A molded lamp socket. The molded lamp socket includes a lamp base body molded from a first plastic material providing a socket cavity with an opening for receiving a lamp bulb. The molded lamp socket also includes a lead extending from a first contact portion disposed in the socket cavity to a second contact portion spaced from the socket cavity. The molded lamp socket also includes a mounting body molded from a second plastic material providing a plug cavity encircling the second contact portion. The mounting body is overmolded with respect to the lamp base body.

16 Claims, 9 Drawing Sheets

FIG - 1
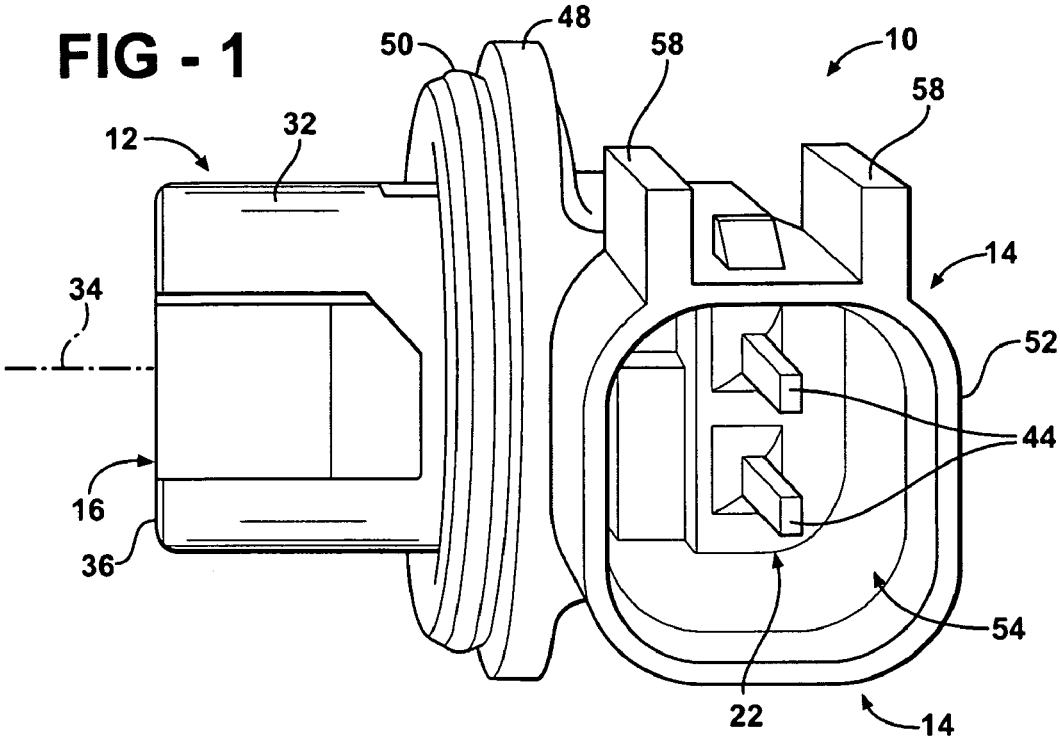
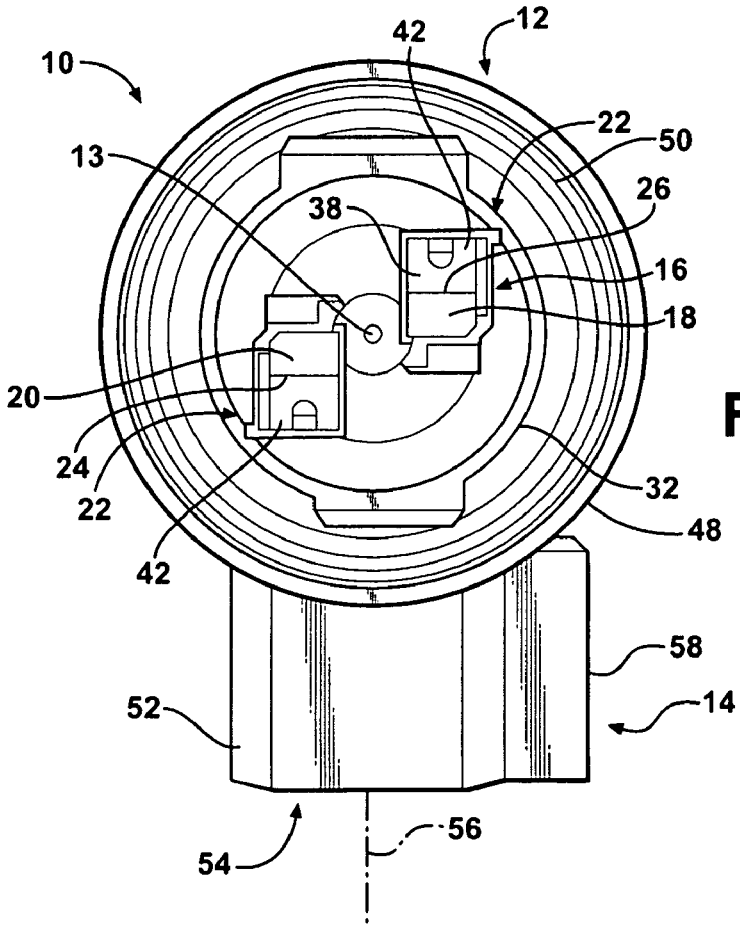
FIG - 2

MOLDED ELECTRICAL SOCKET

CROSS REFERENCE TO RELATED APPLICATIONS

This application is a continuation-in-part of U.S. application Ser. No. 11/553,193, filed on Oct. 26, 2006, which claims the benefit of U.S. Provisional Patent Application No. 60/730,448, filed on Oct. 26, 2005, both of which are hereby incorporated by reference in their entirety.

BACKGROUND OF THE INVENTION

1. Field of the Invention

The invention relates generally wire harnesses, and in particular to molded lamp socket assemblies attached to wire harnesses.

2. Related Art

Many vehicles, industrial applications, and commercial applications use a variety of wiring harnesses. These wiring harnesses are typically specialized for a specific application, and thus, each wiring harness design is typically different. As such, it is difficult, if not impossible, to create a uniform wiring harness suitable for all the different applications, such as for powering traditional applications, including lighting systems of a vehicle. For example, each vehicle may have different lighting locations, different distances between lighting locations, as well as different routes along which the wiring assemblies must run, thereby establishing varying lengths of the wiring assemblies as well as distances between terminals in the wiring assemblies. In addition, each wire in each of the wiring assemblies typically needs to be spliced and taped or epoxied into a wiring connector of the assembly. Further yet, the wires are typically wrapped with heat shrink tubing to secure and seal them with the wiring connector. Given the different locations of the lighting between different models of vehicles, and the numerous locations of splices followed by taping, epoxy, and/or heat shrink wrapping, it has been difficult, if not impossible, to automate the assembly of wiring harnesses. As such, the manufacture and assembly of wiring harnesses and the later installation of wiring harnesses into vehicles is labor intensive and relatively costly.

SUMMARY OF THE INVENTION

A molded lamp socket having a lamp base body defining a socket cavity with an opening for receiving a lamp bulb. The molded lamp socket also includes a lead extending from a first contact portion disposed in the socket cavity to a second contact portion spaced from the socket cavity. The molded lamp socket also includes a mounting body defining a plug cavity encircling the second contact portion. The mounting body is overmolded with respect to the lamp base body and less than all of the lead, the second contact portion being exposed. The lamp base body is formed from a first plastic with a first level of resistance to out-gassing and the mounting body is formed from a second plastic with a second level of resistance to out-gassing less than the first level of out-gassing.

BRIEF DESCRIPTION OF THE DRAWINGS

These and other aspects, features and advantages of the invention will be readily appreciated when considered in connection with the following detailed description of the presently preferred embodiments and best mode, appended claims and accompanying drawings, wherein:

FIG. 1 is a perspective view of a lamp socket assembly constructed in accordance with a first presently preferred aspect of the invention;

FIG. 2 is a top view of the assembly of FIG. 1;

DETAILED DESCRIPTION OF PREFERRED EMBODIMENTS

Figure 3:
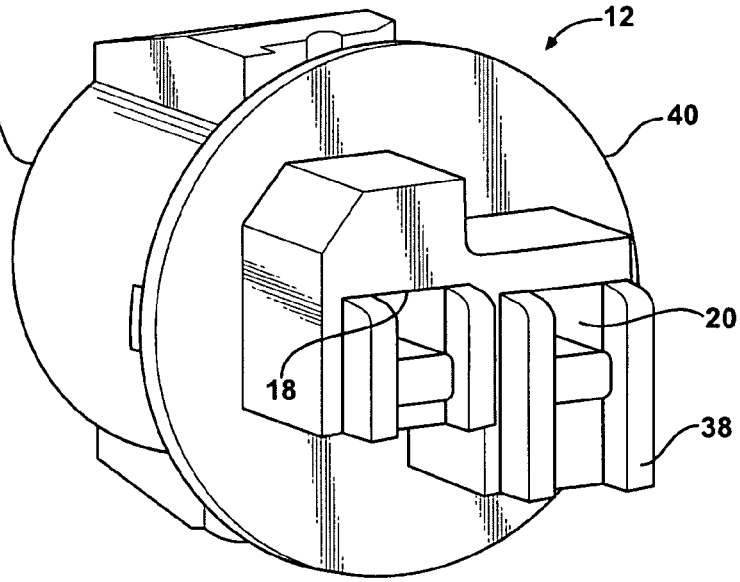
FIG. 3 is a perspective top view of a pre-mold lamp base of the assembly of FIG. 1.

Referring in more detail to the drawings, FIG. 1 illustrates a lamp socket assembly 10 constructed in accordance with a first presently preferred embodiment of the invention. The lamp socket assembly 10 has a lamp base body 12 molded from a first plastic material, wherein the first plastic material can have a first level of resistance to out-gassing. Out-gassing is the phenomena of constituents of plastic being vaporized when the plastic is subjected to heat. Out-gassing can occur in molded lamp sockets as a result of the heat generated by the lamp bulb. When this occurs, the constituents can deposit on the lens of the lamp bulb and make the bulb appear cloudy. The first plastic can be provided as nylon 4,6, such as stanyl, for example. In addition, the lamp socket assembly 10 has an over-molded mounting body or housing 14 that eliminates the need for tape, epoxy, heat shrinking tubing, or other mechanisms to secure and seal wire leads to the assembly 10. Accordingly, the lamp socket assembly is economical in manufacture and in use.

As shown in FIG. 2, the lamp base body 12 includes a socket cavity 16 for receiving a suitably sized lamp bulb. First and second apertures 18, 20 depend from the socket cavity 16 through the body 12 for receipt of at least a portion of first and second electrically conductive contacts, referred to hereafter in relation to this embodiment as leads 22. The lamp base body 12 has first and second projections 24, 26 that extend into the socket cavity 16. The first and second projections 24, 26 are integrally molded as one piece of material with the lamp base body 12 to cooperate with the leads 22 to releasably lock the lamp bulb with respect to the lamp base body 12. The projections 24, 26 can be shaped as necessary, and are represented here as conforming to a depression in the lamp bulb, for example. Thus, the bulb is captured between the lead 22 and the molded plastic lamp base body 12.

Figure 4:
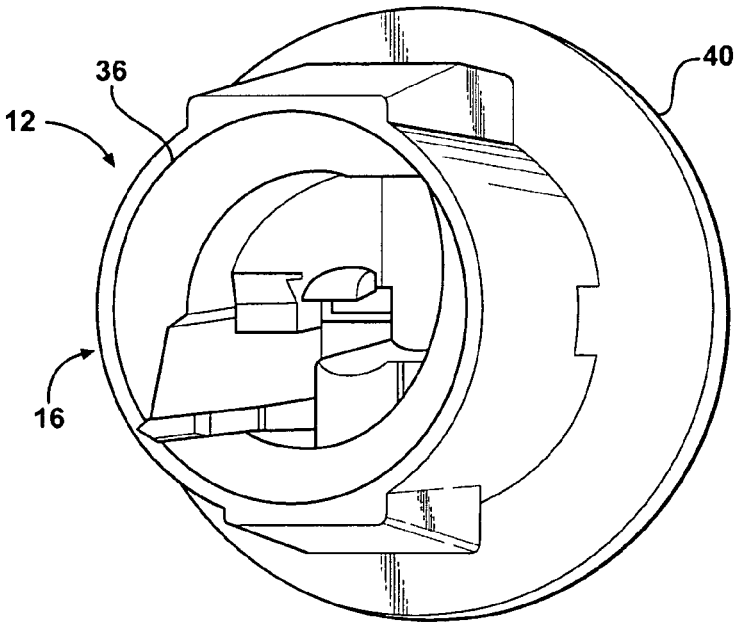
FIG. 4 is a perspective bottom view of the pre-mold lamp base of FIG. 3.

The lamp base body 12 has a cylindrical body portion 32 that extends along a longitudinal axis 34 between a first end 36 and a second end 38 (FIG. 4). An annular rim 40 extends radially outwardly from of the lamp base body 12. In alternative embodiments of the invention, the body portion could be shaped non-cylindrical, such as square, rectangular, or some other shape.

Each lead 22 is represented, by way of example, as having a receptacle end 42 received in the apertures 18, 20 for electrical engagement with a conductive portion of the lamp bulb. The leads 22 also have terminal ends 44 constructed as one piece of metal with the receptacle end 42, with the terminal ends 44 projecting out of the apertures 18, 20. The terminal ends 44 of the leads 22 can be inserted in the socket cavity 16 and through the respective first and second apertures 18, 20 to fix the leads 22 within the lamp base body 12.

The housing 14 is formed from a second plastic material that is over-molded onto at least a portion of the lamp base body 12. The second plastic material can be molded of any suitable plastic material, and can be molded of a plastic material that is the same as or different from the first plastic material of the lamp base body 12, such as nylon 6,6, by way of example and without limitation. In one presently preferred embodiment of the invention, the second plastic material can be provided as being less capable of withstanding the energy emitted from the lamp bulb than the first plastic material. In particular, the housing 14 can be formed from a plastic material having level of resistance to out-gassing that is less than the level of resistance to out-gassing provided by the first plastic material of the lamp base body 12.

The housing 14 can include a radially outwardly extending seal mounting flange 48 to support a seal, such as a rubber gasket or o-ring 50. The housing 14 can also include a peripheral, circumferentially extending wall 52 to provide a plug cavity 54 encircling the terminal ends 44 of the leads 22. The plug cavity 54 extends along an axis 56 (FIG. 2) that is substantially perpendicular to the axis 34 of the lamp base body 12, and facilitates guided engagement between the terminal ends 44 and a female connector (not shown). The housing 14 can also include projections, shown here as a pair of laterally spaced projections 58 extending along the axis 56 to facilitate guided movement between the molded lamp socket assembly 10 and a mounting structure, such as on a vehicle.

Figure 5:
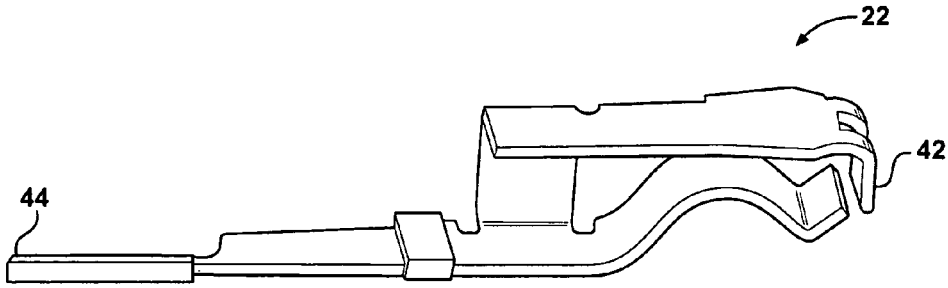
FIG. 5 is a perspective view of a lead shown in a preassembled state.
Figure 6:
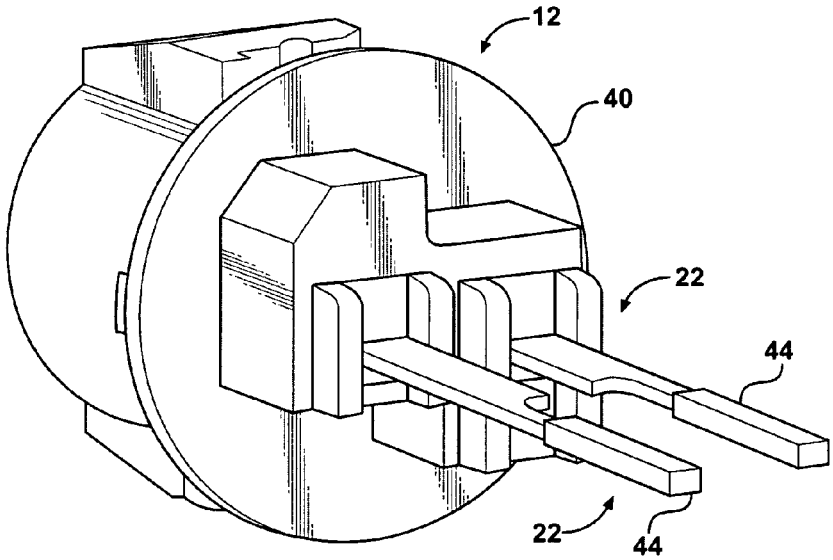
FIG. 6 is a view of the lead of FIG. 5 shown disposed within the pre-mold lamp base of FIG. 3.
Figure 7:
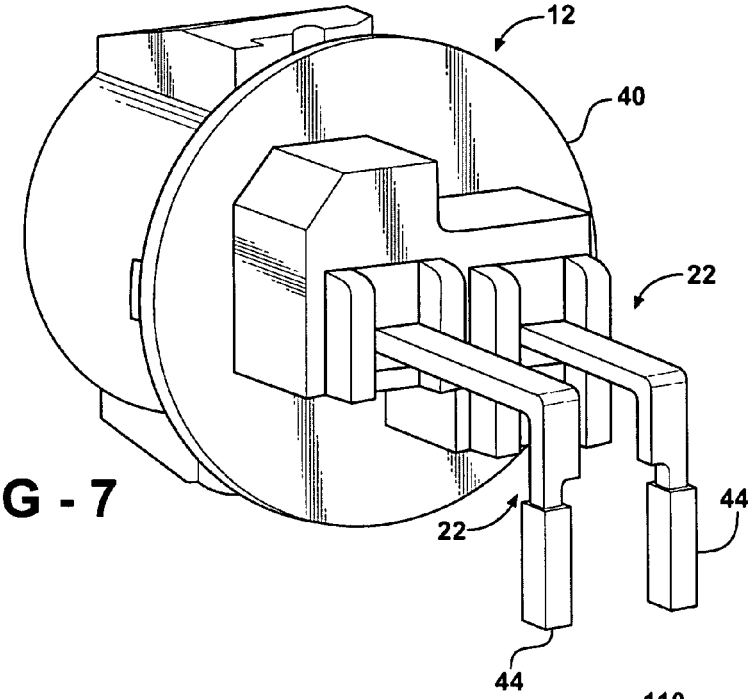
FIG. 7 is a view similar to FIG. 6 with the lead shown bent prior to overmolding a housing onto the pre-mold lamp base in accordance with one presently preferred aspect of the invention.
Figure 8:
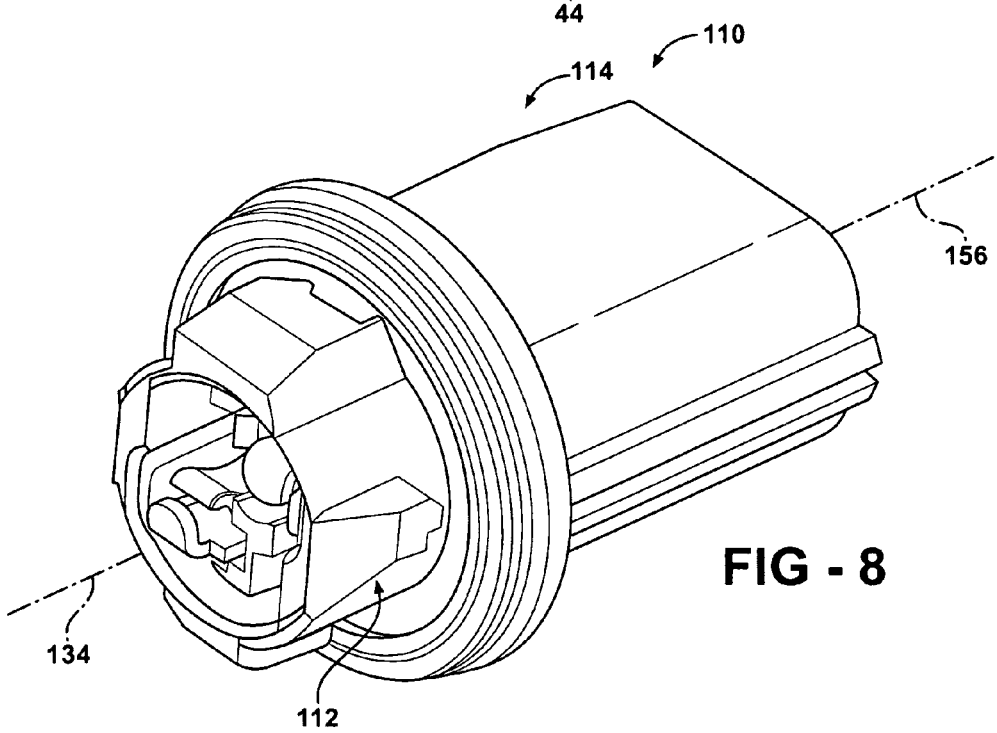
FIG. 8 is a perspective view of a lamp socket assembly constructed in accordance with a second presently preferred aspect of the invention.

According to one presently preferred method of constructing the lamp socket assembly 10, the lamp base body 12 is molded from the first plastic in a mold cavity. Upon molding the body 12, the first and second leads 22, while in a substantially straight configuration, as shown in FIG. 5, are inserted in the socket cavity 14 (FIG. 6) and through the first and second apertures 18, 20, respectively. The receptacle ends 42 of the leads 22 can cooperate with the socket cavity 16 to fix the position of the leads 22 prior to formation of the housing 14. After the leads 22 have been inserted within the lamp base body 12, in accordance with one presently preferred embodiment, the terminal ends 44 can be bent substantially 90 degrees, as shown in FIG. 7, whereupon the receptacle ends 42 and the terminal ends 44 are substantially transverse to one another to form generally L-shaped members. Then, the housing 14 is molded over the annular ridge 40 and the second end 38 of the lamp base body 12, substantially enclosing the first and second apertures 18, 20 and encapsulating and being bonded to a portion of the leads 22 between the receptacle end 42 and the terminal ends 44. It should be recognized that the axes 34, 56 of the respective lamp base body 12 and housing 14 could be greater or less than 90 degrees to one another. For example, in a second exemplary embodiment of a lamp socket assembly 110 constructed in accordance with the invention in FIG. 8, wherein reference numerals offset by a factor of 100 are used to identify similar features as discussed above, the axis 134 of a lamp base body 112 and the axis 156 of a housing 114 are substantially coaxially aligned with one another.

Figure 9:
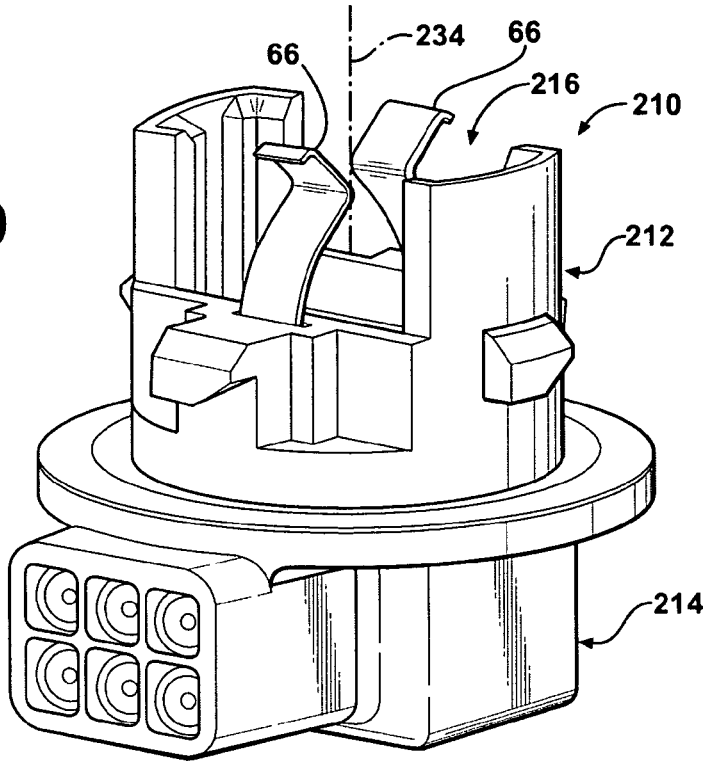
FIG. 9 is a perspective view of a lamp socket assembly constructed in accordance with a third presently preferred aspect of the invention.

In FIG. 9, a lamp socket assembly 210 constructed in accordance with a another presently preferred embodiment of the invention is illustrated, wherein reference numerals offset by a factor of 200 are used to identify similar features as discussed above. The lamp socket has a daisy chain type lamp base body 212 molded from a first plastic material, such as nylon 4,6, for example, and an over-molded mounting body or housing 214 molded from a second plastic material that can be the same as or different from the first plastic material. The lamp base body 212 is molded in a first molding process within a mold cavity shaped to provide the desired body configuration to accommodate the intended size lamp bulb and application. The lamp base body 212 is formed with an upper socket cavity 216 extending along a longitudinal axis 234 and a lower terminal portion 60. The socket cavity 216 can be formed having a plurality of apertures or openings, referred to hereafter as pockets, depending therein to accommodate any number and combination of electrical contacts and lock fingers. For example, as shown in cross-section in FIG. 11, the lamp base body 212 can have a pair of pockets identified generally at 218 depending into the socket cavity 216 for receipt of a major contact 62 and a ground contact 64. It should be recognized that additional pockets could be provided for receipt of a minor contact, such as used with a dual filament bulb, for example. Further, the lamp base body 212 can have a pair of apertures 220 depending through the body 212 for receipt of a pair of lock fingers 66 therethrough. In the embodiment shown, the apertures 220 are formed as through passages such that a distal portion or end 72 of the lock fingers 66 can be inserted through the apertures 220 to extend outwardly therefrom to facilitate construction of the lamp socket assembly 210 in subsequent operations.

The lower terminal portion 60 of the lamp base body 212 depends from the upper socket cavity 216 to accommodate various types of terminals, depending on the type of connector being constructed. For example, the daisy chain type lamp socket assembly 210 has a plurality of through openings 68 extending generally transverse to the axis 234 for receipt of a corresponding number of through terminals. It should be recognized that some of the terminals can be arranged in electrical communication with the major and ground contacts 62, 64, thereby being functional terminals 74, while others can simply pass through the lower terminal portion 60, thereby being pass through terminals 76 for electrical communication with other functional members (not shown).

Upon molding the lamp base body 212 from the first plastic material, the major and ground contacts 62, 64 and the lock fingers 66 are inserted into their respective pockets 218 and apertures 220 formed in the first molding process. The lock fingers 66 are inserted into the apertures 220 such that the end 72 of each lock finger extends outwardly and downwardly of the respective aperture. Accordingly, the lamp base body 212, after being pre-molded in the first molding process, is fully populated with all the contacts and lock fingers for subsequent overmolding of the housing 214.

Figure 10:
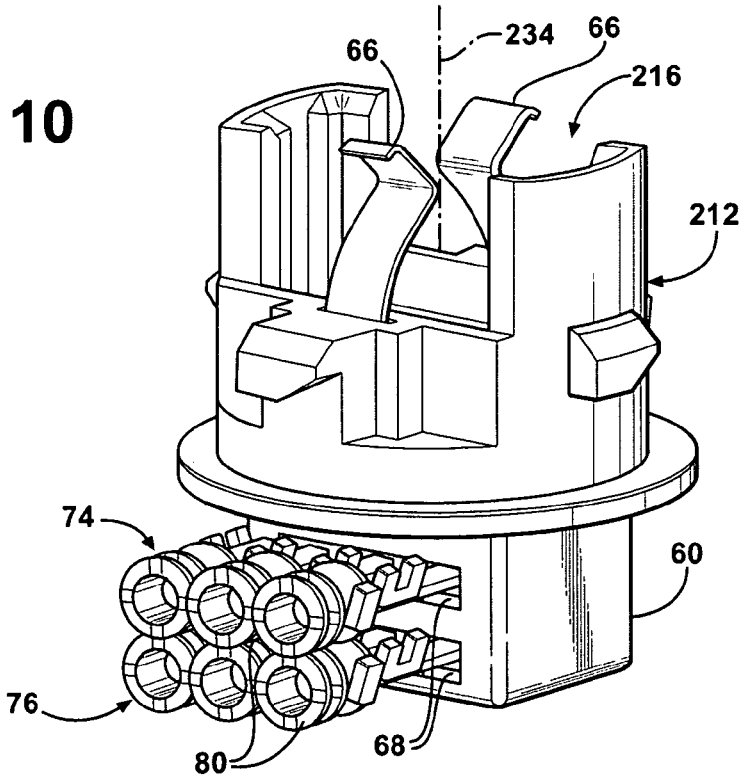
FIG. 10 is a perspective view of a pre-mold lamp base subassembly of the assembly of FIG. 9 shown with lock fingers, contacts, terminals and cable seals inserted therein.
Figure 11:
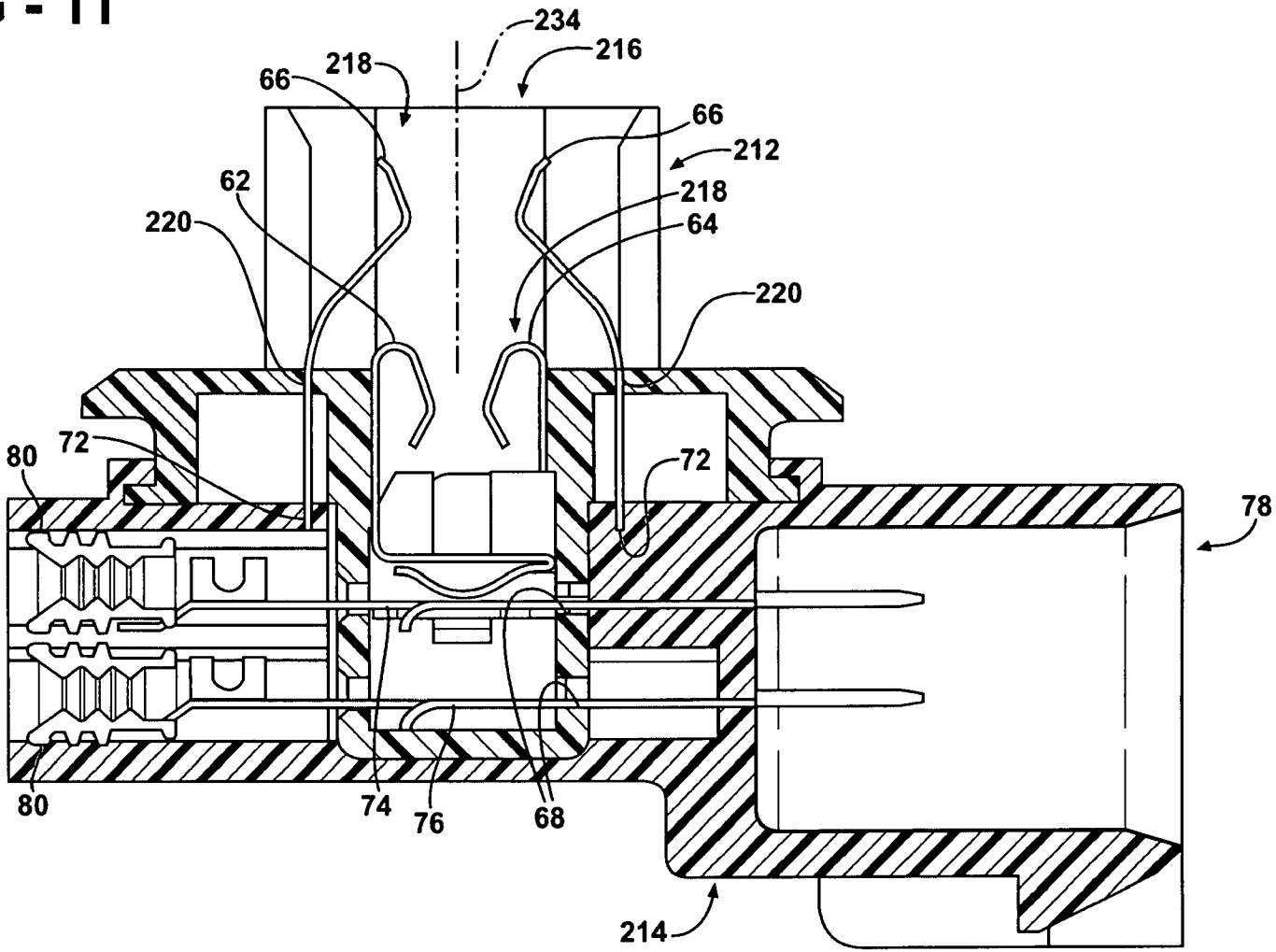
FIG. 11 is a cross-sectional view taken generally along line 11-11 of FIG. 9.

Upon populating the lamp base body 212 to form a subassembly, as shown in FIG. 10, the subassembly is placed in another mold cavity (not shown) for over-molding the second plastic material. The second plastic material can be selected as the same material used for the first plastic material, or from a less expensive second plastic material than that selected for the first plastic material, if desired, to form the over-molded housing 214. The over-molding can be performed in an injection molding process such that the second plastic material is injected about the desired portion of the upper lamp base body 212 and about the ends 72 of the lock fingers 66. Upon completion of over-molding the housing 214, the ends 72 of the lock fingers 66 are encapsulated and fixed in the subassembly by being bonded within the second plastic material of the housing 214, as shown in FIG. 11.

Next, the housing 214 is populated with the desired terminals. The daisy chain type lamp socket assembly 210 is shown having three upper functional terminals 74, by way of example and without limitation, that provide the function of passing electricity to the bulb used in the application by being in electrical communication with the major and minor contacts 62, 64. Further, the socket assembly 210 has three lower pass through terminals 76, by way of example and without limitation, arranged out of electrical communication with the major and minor contacts 62, 64, and thus, out of electrical communication with the bulb. Each of the terminals 74, 76 are shown as extending completely through the housing 214 to provide male connector portions 75 extending into a plug cavity 78 of the housing 214 formed in the over-molding process.

In application, cable seals 80 can be incorporated to be crimped along with the terminals to ends of the wires (not shown) to facilitate forming a seal between the wire end and the terminal. Further, a flange seal (not shown) can be disposed about the wires for sealing receipt about housing. As such, the need for taping, potting and/or shrink tubing to establish a seal is negated.

Figure 12:
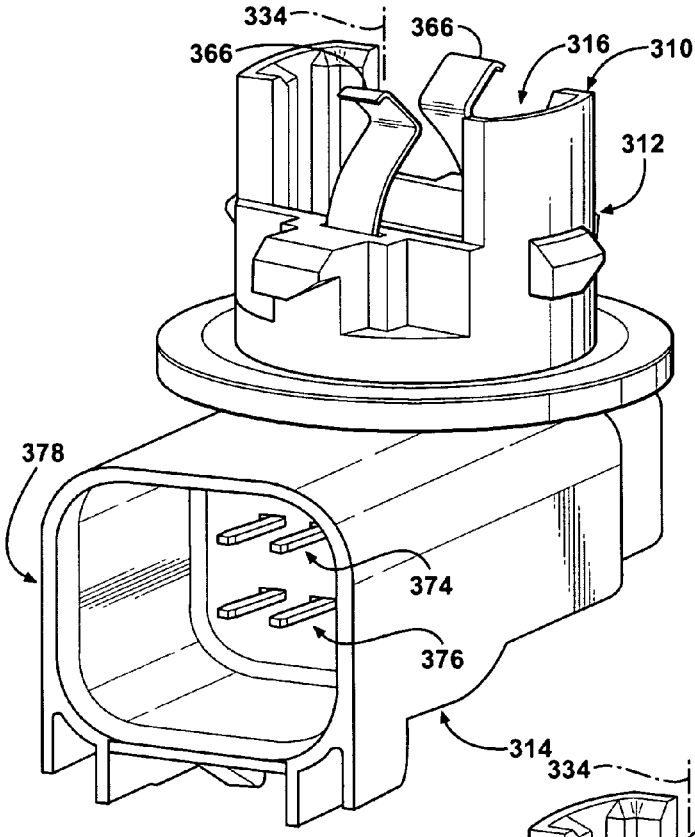
FIG. 12 is a perspective view of a lamp socket assembly constructed in accordance with a fourth presently preferred aspect of the invention.
Figure 13:
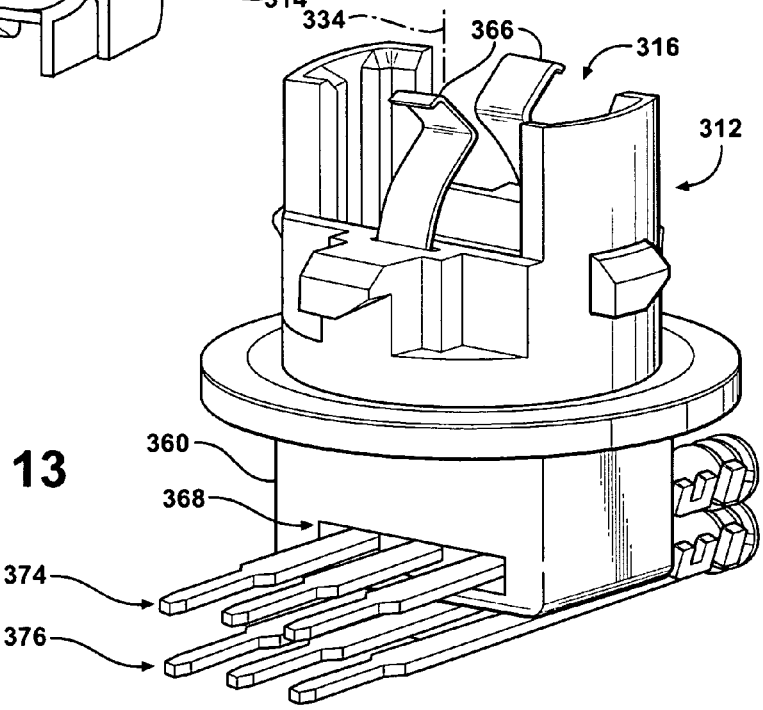
FIG. 13 is a perspective view of a pre-mold lamp base of the assembly of FIG. 12 shown with terminals and cable seals inserted therethrough.

In FIG. 12, a lamp socket assembly 310 constructed in accordance with a another presently preferred embodiment of the invention is illustrated, wherein reference numerals offset by a factor of 300 are used to identify similar features as discussed above. The lamp socket assembly 310 has what is commonly referred to as a spyder-type lamp base body 312. As with the assembly 210 discussed above, the body 312 is molded from a first plastic material, and has a mounting body or housing 314 over-molded from a second plastic material, wherein the second plastic material can be the same as or different from the first plastic material, depending on the application. The lamp base body 312 is formed with an upper socket cavity 316 extending along a longitudinal axis 334 and a lower terminal portion 360 (FIG. 13). The socket cavity 316 is formed with a plurality of pockets depending therein to accommodate any number and combination of electrical contacts and a pair of apertures (similar to those shown in FIG. 11) depending through the body 312 for receipt of a pair of lock fingers 366. The lock fingers 366 are inserted through the apertures to extend partially outwardly therefrom.

The lower terminal portion 360 of the lamp base body 312 depends from the upper socket cavity 316 along the axis 334 and has a plurality of pass through openings 368 extending generally transverse to the axis 334 for receipt of a corresponding number of terminals. In the embodiment shown, three pass through openings 368 are formed for receipt of three upper function terminals 374 that are arranged in electrical communication with the contacts (similar as shown in FIG. 11) to illuminate the bulb (not shown).

Upon molding the lamp base body 312 from the first plastic material, the major and ground contacts and the lock fingers 366 are inserted into their respective pockets and apertures formed in the first molding process. The lock fingers 366, as with the lock fingers 66 discussed above, are inserted into the apertures such that an end of each lock finger extends outwardly and downwardly from the lamp base body 312.

Upon populating the lamp base body 312 with the three function terminals 374 to form a subassembly (FIG. 13), the subassembly is placed in another mold cavity for over-molding the second plastic material to form the over-molded housing 314. In addition to inserting the subassembly into the mold cavity, a plurality of additional pass through terminals 376 are supported beneath the lamp base body 312 in spaced relation from the lamp base body 312, shown here, for example, as three pass through terminals 376 aligned relative to the functional terminals 374. The overmolding can be performed in an injection molding process such that the second plastic material is injected and bonded about the desired portion of the upper lamp base body 312 and about the ends of the lock fingers 366 (as shown in FIG. 11 of the assembly 210). Further, the plastic of the housing 314 is molded about a portion of the pass through terminals 376 spaced from the body 312 to fix the terminals 376 in their desired position in the lamp socket assembly 310. One end of each the functional terminals 374 and the pass through terminals 376 extend as male connectors with in a plug cavity 378 formed by the over-molded plastic for plug and play type connection, while the opposite ends of the terminals 374, 376 present connectors for attachment to wires (similar to that shown in FIG. 11).

Figure 14:
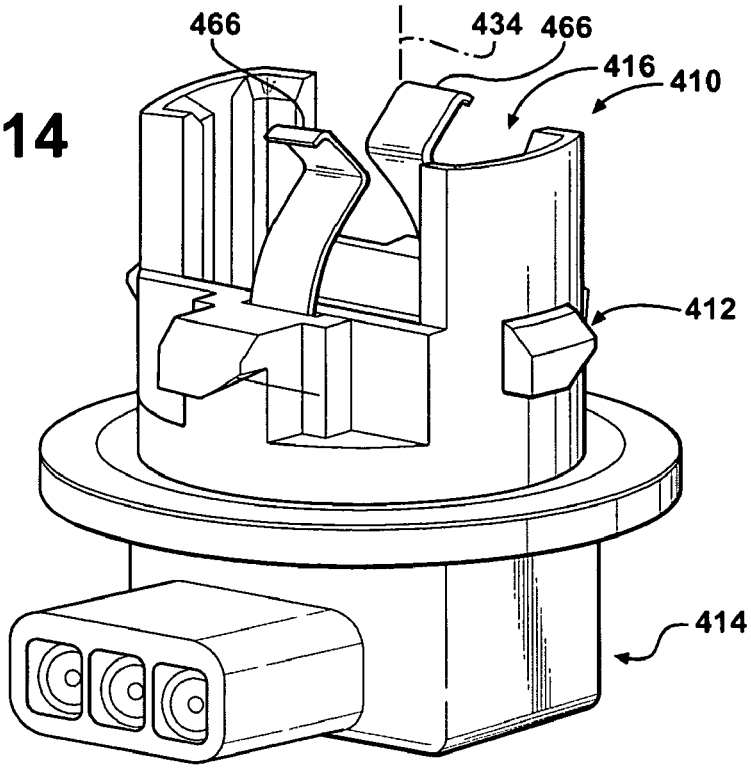
FIG. 14 is a perspective view of a lamp socket assembly constructed in accordance with a fifth presently preferred aspect of the invention.

In FIG. 14, a lamp socket assembly 410 constructed in accordance with a another presently preferred embodiment of the invention is illustrated, wherein reference numerals offset by a factor of 400 are used to identify similar features as discussed above. The lamp socket assembly 410 has what is commonly referred to as a connectorless-type lamp base body 412. As with the assemblies 210, 310 discussed above, the body 412 is molded from a first plastic material, and has a mounting body or housing 414 over-molded from a second plastic material, wherein the second plastic material can either be the same plastic material or it can be a different plastic material than used for the first plastic material. The lamp base body 412 is formed with an upper socket cavity 416 extending along a longitudinal axis 434 and a lower terminal portion 460. The socket cavity 416 is formed with a plurality of pockets depending therein to accommodate any number and combination of electrical contacts and a pair of apertures (similar to those shown in FIG. 11) depending through the body 412 for receipt of a pair of lock fingers 466. The lock fingers 466 have proximal end portions for engagement with the bulb and distal end portions inserted through the apertures and partially outwardly therefrom.

Figure 15:
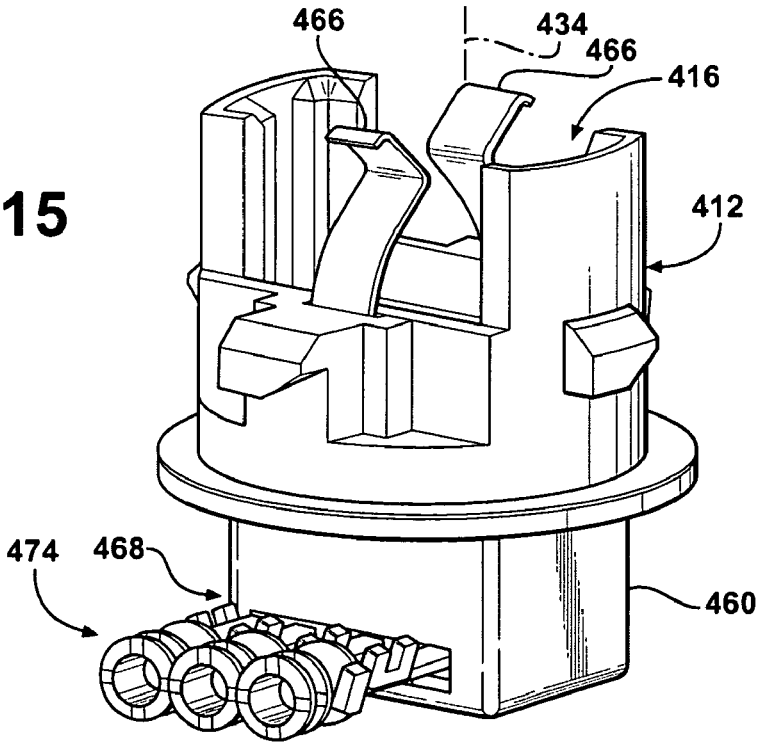
FIG. 15 is a perspective view of a pre-mold lamp base of the assembly of FIG. 14 shown with terminals and cable seals inserted therein.

As shown in FIG. 15, the lower terminal portion 460 of the lamp base body 412 depends from the upper socket cavity 416 and has a plurality of openings 468 extending generally transverse to the axis 434 for receipt of a corresponding number of terminals. In the embodiment shown, three openings 468 are formed in one side of the lower terminal portion 460 for receipt of three function terminals 474 that are arranged in electrical communication with the contacts to illuminate the bulb (not shown). The functional terminals 474 are provided to terminate within the lower terminal portion 460, as the openings 468 are not formed as through openings as in the previously described embodiment.

Upon molding the lamp base body 412 from the first plastic material, the major and ground contacts and the lock fingers 466 are inserted into their respective pockets and apertures formed in the first molding process. The lock fingers 466, as with the lock fingers 66 discussed above, are inserted into the apertures such that an end of each lock finger extends outwardly from the lamp base body 412.

Upon populating the lamp base body 412 with the three function terminals 474 to form a subassembly (FIG. 15), the subassembly is placed in another mold cavity for overmolding the second plastic material to form the over-molded housing 414. The over-molding can be performed in an injection molding process such that the second plastic material is injected about the desired portion of the upper lamp base body 412 and about the distal end portions of the lock fingers 466. One end of each the functional terminals 474 terminate and are maintained in electrical contact with the internal metal contacts, while the opposite ends of the terminals 474 present connections to wires (not shown).

Figure 16:
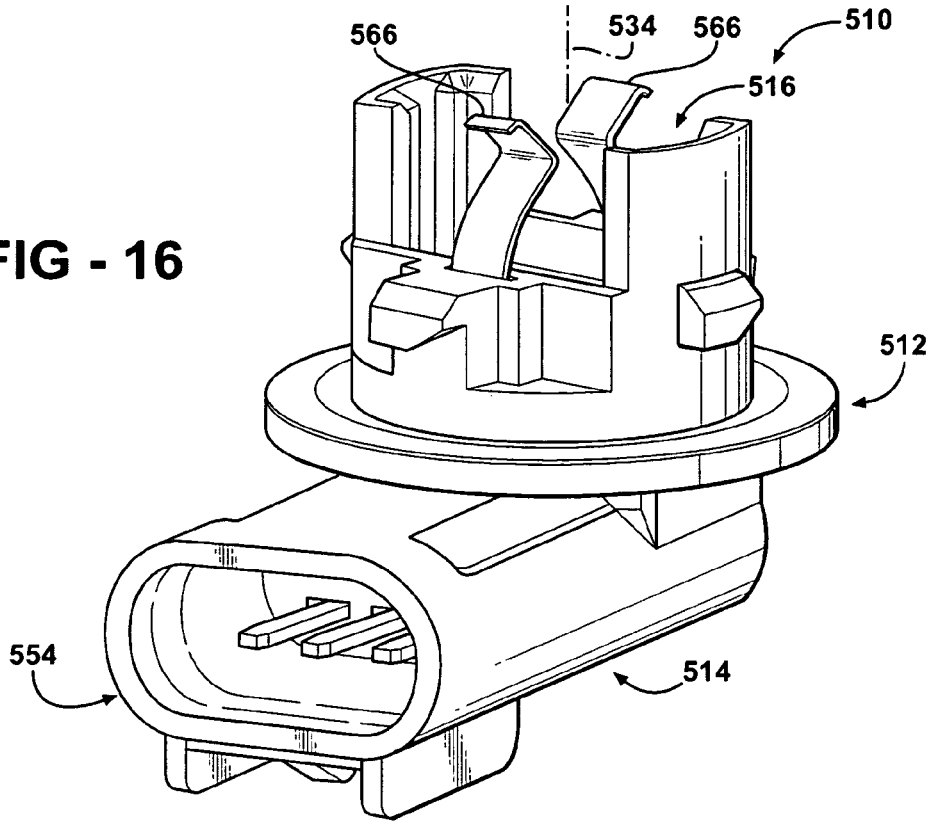
FIG. 16 is a perspective view of a lamp socket assembly constructed in accordance with a sixth presently preferred aspect of the invention.

In FIG. 16, a lamp socket assembly 510 constructed in accordance with a another presently preferred embodiment of the invention is illustrated, wherein reference numerals offset by a factor of 500 are used to identify similar features as discussed above. The lamp socket has what is commonly referred to as a connector-type lamp base body 512. As with the assemblies 210, 310, 410 discussed above, the body 512 is molded from a first plastic material, and has a mounting body or housing 514 overmolded from a second plastic material, wherein the second plastic material can be the same as or different from the first plastic material. The lamp base body 512 is formed with an upper socket cavity 516 extending along a longitudinal axis 534 and a lower connector-type terminal portion 560. The socket cavity 516 is formed with a plurality of pockets depending therein to accommodate any number and combination of electrical contacts and a pair of apertures (similar to those shown in FIG. 11) depending through the body 512 for receipt of a pair of lock fingers 566. The lock fingers 566 have proximal end portions for engagement with the bulb and distal end portions inserted through the apertures and partially outwardly therefrom.

Figure 17:
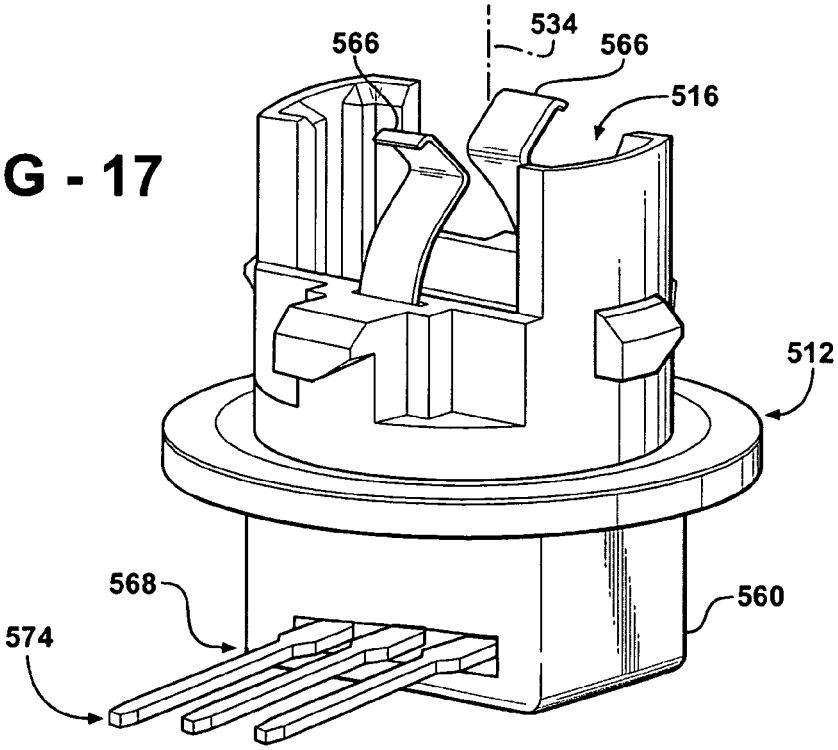
FIG. 17 is a perspective view of a pre-mold lamp base of the assembly of FIG. 16 shown with terminals inserted therein.

As shown in FIG. 17, the lower connector-type terminal portion 560 of the lamp base body 512 depends from the upper socket cavity 516 and has a plurality of openings 568 extending generally transverse to the axis 534 for receipt of a corresponding number of connector-type blade terminals 574. In the embodiment shown, three openings 568 are formed in one side of the lower terminal portion 560 for receipt of three functional terminals 574 that are arranged in electrical communication with the contacts enclosed with the body 512 to illuminate the bulb (not shown). The functional terminals 574 are provided to terminate within the lower terminal portion 560, as the openings 568 are not formed as through openings as in some of the previously described embodiments.

Upon molding the lamp base body 512 from the first plastic material, the major and ground contacts and the lock fingers 566 are inserted into their respective pockets and apertures formed in the first molding process. The lock fingers 566, as with the lock fingers 66 discussed above, are inserted into the apertures such that an end of each lock finger extends outwardly from the lamp base body 512.

Upon populating the lamp base body 512 with the three functional terminals 574 to form a subassembly (FIG. 17), the subassembly is placed in another mold cavity for overmolding the second plastic material to form the over-molded housing 514. The over-molded material is injected about the desired portion of the upper lamp base body 512 and about the distal end portions of the lock fingers 566 to secure the lock fingers in a fixed position. One end of each the functional terminals 574 terminate in the body 512 and are maintained in electrical contact with the internal metal contacts, while the opposite ends of the terminals 574 present blade connectors for attachment to another electrical connector (not shown). The blade connectors are preferably encircled by an outer, protective wall of the housing 514 to provide a plug cavity 554 for receipt of the other electrical connector.

Many modifications and variations of the present invention are possible in light of the above teachings. It is, therefore, to be understood that within the scope of the appended claims, the invention may be practiced otherwise than as specifically described.

What is claimed is:

1. A lamp socket assembly, comprising:

a lamp base body molded from a first plastic material, said lamp base body having an upper portion formed with a socket cavity configured for receipt of a bulb and a lower portion depending from said upper portion;

a plurality of contacts disposed in said socket cavity;

a plurality of functional terminals configured in electrical communication with said contacts;

a plurality of pass through terminals configured out of electrical communication with each of said contacts;

a housing overmolded onto at least a portion of said lower portion of said lamp base body, said housing being molded from a second plastic material separate from said first plastic material; and wherein said lower portion of said lamp base body has a through opening receiving said functional terminals and said pass through terminals, said housing being overmolded about a portion of said functional terminals and about a portion of said pass through terminals and fixing said functional terminals and said pass through terminals to said lamp base body.

2. The lamp socket assembly of claim 1 wherein said contacts and said functional terminal are constructed from a single piece of metal.

3. The lamp socket assembly of claim 2 wherein said contacts and said functional terminals extend substantially transverse to one another.

4. The lamp socket assembly of claim 1 wherein said housing has a plug cavity encircling said functional terminals and said pass through terminals.

5. The lamp socket assembly of claim 4 wherein said socket cavity extends along a first axis and said plug cavity extends along a second axis, said first and second axes being one of substantially transverse or substantially aligned with one another.

6. The lamp socket assembly of claim 5 wherein said first and second axes are substantially transverse with one another.

7. The lamp socket assembly of claim 1 wherein said first plastic material and said second plastic material are different plastic materials.

8. The lamp socket assembly of claim 7 wherein said first plastic material has a first resistance to out-gassing and said second plastic material has a second resistance to out-gassing, said second resistance to out-gassing being less than said first resistance to out-gassing.

9. A lamp socket assembly, comprising:

a lamp base body molded from a first plastic material, said lamp base body having an upper portion formed with a socket cavity configured for receipt of a bulb and a lower portion depending from said upper portion;

a plurality of contacts disposed in said socket cavity, each of said contacts being arranged for electrical communication with at least one terminal received at least in part in said lower portion;

a housing overmolded onto at least a portion of said lower portion of said lamp base body, said housing being molded from a second plastic material separate from said first plastic material; and a pair of metal lock fingers spaced out of electrical communication from each of said contacts, said lock fingers having proximal ends configured to engage the bulb and distal ends, said lamp base body having a pair of circumferentially enclosed apertures spaced radially outwardly from said socket cavity, said circumferentially enclosed apertures receiving said distal end of said lock fingers therethrough, said housing being overmolded to bond with said distal ends.

10. A lamp socket assembly, comprising:

a lamp base body molded from a first plastic material, said lamp base body having an upper portion formed with a socket cavity configured for receipt of a bulb and a lower portion depending from said upper portion;

a contact disposed in said socket cavity, said contact being arranged for electrical communication with a terminal received at least in part in said lower portion;

a housing overmolded onto at least a portion of said lower portion of said lamp base body, said housing being molded from a second plastic material separate from said first plastic material;

wherein said lower portion of said lamp base body extends along an axis, said lower portion having a through opening extending substantially transverse to said axis and receiving said terminal, said housing being overmolded about a portion of said terminal and fixing said terminal to said lamp base body; and further comprising a plurality of said terminals in spaced relation from said lower portion of said lamp base body, said housing being overmolded about a portion of each of said plurality of terminals and fixing said terminals to said lamp base body.

11. The lamp socket assembly of claim 10 wherein said plurality of terminals each have one end configured for attachment to a plug and another end configured for attachment to a wire.

12. A method of constructing a lamp socket assembly, comprising:

molding a first plastic material into a lamp base body having an upper portion formed with a socket cavity configured for receipt of a bulb, a pair of circumferentially continuous apertures spaced radially outwardly from the socket cavity, and a lower portion depending from the upper portion along an axis, the lower portion being formed having a through opening extending substantially transverse to the axis;

inserting a plurality of contacts in the cavity;

inserting at least one terminal through the through opening in electrical communication with at least one of the contacts;

disposing a pair of metal lock fingers through the apertures of the lamp base body out of electrical communication with each of the contacts, the metal lock fingers being configured having proximal ends for retaining the bulb in the socket cavity and distal ends; and overmolding a second plastic material about the lamp base lower portion to form a housing bonded to the lamp base lower portion and also causing the housing to be bonded with distal ends of the metal lock fingers.

13. The method of claim 12 further including molding a plurality of through openings in the lower portion extending substantially transverse to the axis and disposing a plurality of terminals in the openings.

14. The method of claim 13 further including overmolding the plurality of terminals with the second plastic material.

15. A method of constructing a lamp socket assembly, comprising:

molding a first plastic material into a lamp base body having an upper portion formed with a socket cavity configured for receipt of a bulb, a pair of apertures spaced outwardly from the socket cavity, and a lower portion depending from the upper portion along an axis, the lower portion being formed having a through opening extending substantially transverse to the axis;

inserting a contact in the cavity;

inserting a terminal through the through opening in electrical communication with the contact;

disposing a pair of metal lock fingers through the apertures of the lamp base body out of electrical communication with the contact, the metal lock fingers being configured having proximal ends for retaining the bulb in the socket cavity and distal ends;

overmolding a second plastic material about the lamp base lower portion to form a housing bonded to the lamp base lower portion and also causing the housing to be bonded with distal ends of the metal lock fingers;

molding a plurality of through openings in the lower portion extending substantially transverse to the axis and disposing a plurality of terminals in the openings; and suspending a second plurality of terminals in spaced relation from the lower portion of the lamp base body out of electrical contact with the contact and overmolding the second plurality of terminals with the second plastic material.

16. The method of claim 15 further including providing the second plurality of terminals with one end configured for attachment to a plug and another end configured for attachment to a wire.

* * * * *